United States Patent [19]

Yamaryo

[11] Patent Number: 4,809,580

[45] Date of Patent: Mar. 7, 1989

[54] KEY MECHANISM FOR A BASS CLARINET

[75] Inventor: Shigeru Yamaryo, Shizuoka, Japan

[73] Assignee: Yamaha Corporation, Japan

[21] Appl. No.: 109,488

[22] Filed: Oct. 16, 1987

[30] Foreign Application Priority Data

Oct. 17, 1986 [JP] Japan ..... 61-246856

[51] Int. Cl.[4] ..... G10D 7/06

[52] U.S. Cl. ..... 84/382

[58] Field of Search ..... 84/380 R, 382

[56] References Cited

U.S. PATENT DOCUMENTS

| | | | |
|---|---|---|---|
| 950,602 | 3/1910 | Ramos | 84/382 |
| 2,649,829 | 8/1953 | Loney | 84/382 |
| 2,867,146 | 1/1959 | Mazzeo | 84/382 |

*Primary Examiner*—Lawrence R. Franklin

*Attorney, Agent, or Firm*—Ostrolenk, Faber, Gerb & Soffen

[57] ABSTRACT

In construction of a key mechanism for a bass clarinet, some of the conventional keys on the lower joint are modified in arrangement for smoother and easier finger motion needed for key operation in particular during bass range performance.

1 Claim, 2 Drawing Sheets

KEY MECHANISM FOR A BASS CLARINET

BACKGROUND OF THE INVENTION

The present invention relates to an improved key mechanism for a bass clarinet, and more particularly relates to an improvement in arrangement of keys on a bass clarinet.

In the field of woodwinds such as clarinets, increasing variety and complication in manner of performance and finger motion require more complicated key arrangement on the body of the instrument. In particular, a bass clarinet has a length by far greater than those of other woodwinds and, as a consequence, is provided a larger number of keys to be operated by player's fingers. Since the keys have to be collected within the operating ambit of the players fingers, presence of such larger number of keys furthers complication in key arrangement.

In the case of a typical conventional bass clarinet, five levers have to be arranged on the upper section of its lower joint. These five levers are an F/C lever, a Low D lever, an F♯ (F sharp)/C♯ (C sharp) lever, an E/B lever and an Ab(A flat)/Eb(E flat) lever. In addition, several keys are arranged on the upper section at their specified positions. For example, a Low C♯ key and a low C key are arranged close to each other at positions operable by the right hand thumb. Further, a Low D key, an F/C key, an Ab/Eb key, an F♯/C♯ key, an E/B key and a Low Eb key are arranged in group on the upper section for operation by the right hand little finger.

During performance of a bass clarinet, these keys are operated by respective fingers as shown in the following Tables for generation of musical notes.

TABLE 1

| | Note | |
|---|---|---|
| | Low C | Low C♯ |
| Left hand | | |
| thumb | Thumb key | Thumb key |
| forefinger | F♯ key | F♯ key |
| middle finger | A/D key | A/D key |
| ring finger | C/G key | C/G key |
| little finger | | |
| Right hand | | |
| thumb | Low C key | Low C♯ key |
| forefinger | Bb/F key | Bb/F key |
| middle finger | A/E key | A/E key |
| third finger | D/G key | D/G key |
| little finger | Low D key | Low D key |

TABLE 2

| | Note | |
|---|---|---|
| | Low D | Low Ab |
| Left hand | | |
| thumb | Thumb key | Thumb key |
| forefinger | F♯ key | F♯ key |
| middle finger | A/D key | A/D key |
| ring finger | C/G key | C/G key |
| little finger | | |
| Right hand | | |
| thumb | | |
| fore finger | Bb/F key | Bb/F key |
| middle finger | A/E key | A/E key |
| third finger | D/G key | D/G key |
| little finger | Low D key | Ab/Eb key |

During performance in the bass range, two keys must be operated by the right hand thumb and six keys must be operated by the right hand little finger. With the conventional key arrangement, two out of the six keys to be operated by the little finger are arranged quite separate from each other and such a separate arrangement makes the corresponding finger motion very difficult. More specifically, the right hand thumb needs to be operable on the Low C and Low C♯ keys only whereas the right hand little finger must cover the Low D, Ab/Eb, F♯/C♯, F/C, E/B and Low Eb keys. During performance in the bass range, the little finger sometimes operate the Low D and Ab/Eb keys in succession which are quite separated in position from each other. Such performance clearly requires difficult finger motion. In addition generation of tremolos with the conventional key arrangement requires highly skilled technique in performance.

SUMMARY OF THE INVENTION

It is the object of the present invention to provide a key arrangement on a bass clarinet which allows easier key operation without any need for highly skilled technique.

According to the basic aspect of the present invention, keys used during bass range performance on a bass clarinet are modified in arrangement on the lower joint so as to require smooth finger motion only.

DESCRIPTION OF THE PREFERRED EMBODIMENTS

Figure 3:
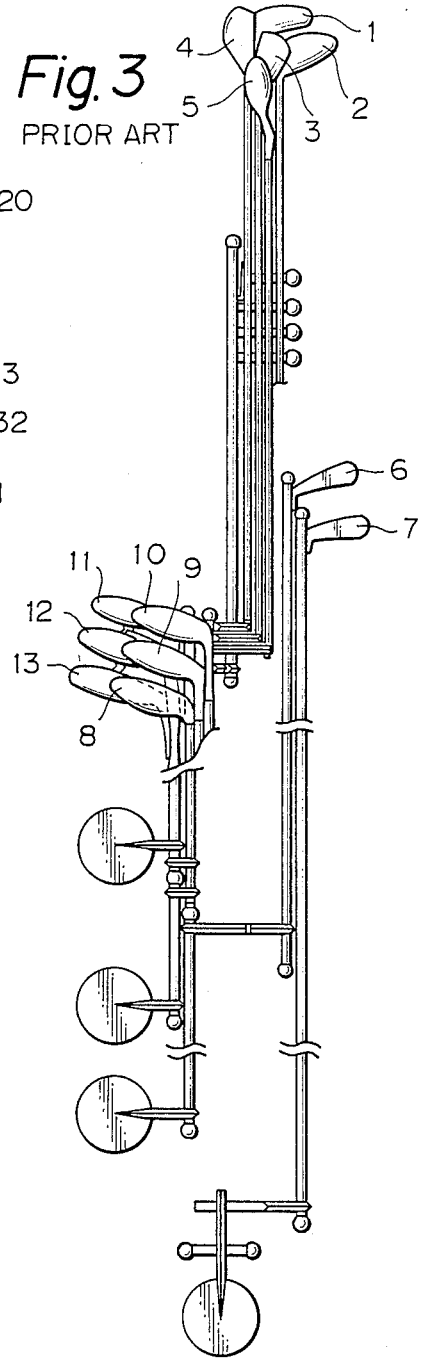
Fig. 3 PRIOR ART
FIG. 3 is a simplified extended view of a typical example of the conventional key mechanism.

A typical example of the key mechanism on a bass clarinet is shown in FIG. 3. The lower joint of the bass clarinet is provided with an F/C lever 1, a Low D lever 2, an F♯/C♯ lever 3, an E/B lever 4 and an Ab/Eb lever 5. Somewhat below these levers, the lower joint is further provided with a Low C♯ key 6, a Low C key 7, a Low D key 8, an F/C key 9, an Ab/Eb key 10, an F♯/C♯ key 11, an E/B key 12 and a Low Eb key 13. As is clear from the illustration, the Low D key 8 and the Ab/Eb key 10 are separated in position from each other.

Figure 1:
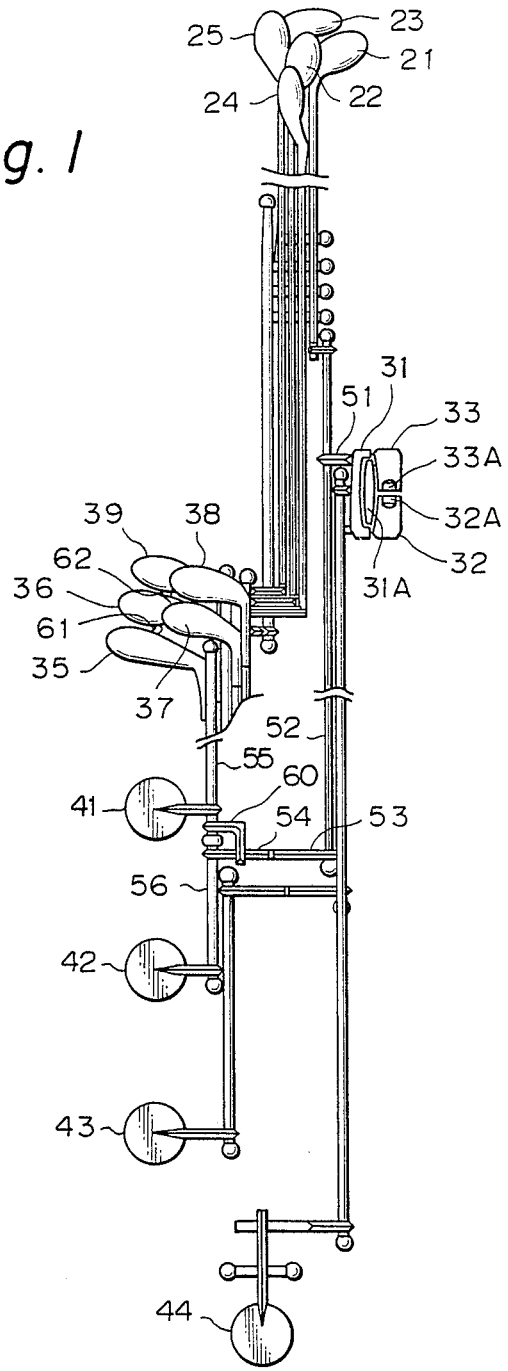
FIG. 1 is a simplified extended view of one embodiment of the key mechanism of the present invention.
Figure 2:
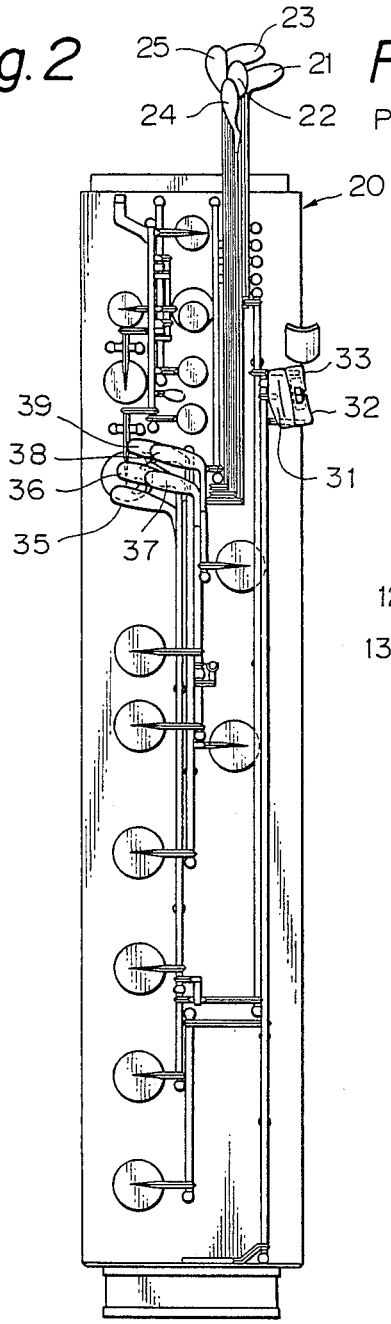
FIG. 2 is a front view of the main part of the key mechanism shown in FIG. 1.

One embodiment of the key mechanism in accordance with the present invention is shown in FIGS. 1 and 2. The lower joint 20 of a bass clarinet is provided, at its top end, with a Low D lever 21, an F♯/C♯ lever 22, an F/C lever 23, an Ab/Eb lever 24 and an E/B lever 25 arranged close to each other in a group. Each of the lever is constructed to close an associated sound hole via a rotary bar, an arm and a pad or to be operationally connected to an associated key. When a lever or an associated key is not operated, the associated pad leaves the corresponding sound hole open while being urged by an associated needle spring.

At a position far below the levers, a Low C key 31, a Low C♯ key 32 and a Low D key 33 are arranged collectively on the lower joint 20 within the operating ambit of the right hand thumb. The keys 31 to 33 are accompanied with rollers 31A to 33A, respectively. These rollers 31A to 33A are constructed rotatable for easy continuous finger motion. These keys 31 to 33 are partly superposed one on another in an arrangement such that operation on the Low C key 31 should cause concurrent operation on the Low C# key 32 and the Low D key 33 and that operation on the Low C# key 32 cause concurrent operation on the Low D key 33.

More specifically, as shown with dot lines in FIG. 2, the Low C key 31 is arranged over arms connected to the Low C# key 32 and the Low D key 33 so that depression of the Low C key 31 should automatically cause concurrent depression of other keys 32 and 33. Further, an arm extends from the Low D key 33 to the underside of the Low C# key 32 so that depression of the Low C# key 32 should cause concurrent depression of the Low D key 33. However, depression of the Low D key 33 causes no corresponding movement of the Low C# key 32.

At a position somewhat below the group of keys 31 to 33, on the opposite side of the group on the lower joint 20, are collectively arranged a Low Eb key 35, an E/B key 36, an F/C key 37, an Ab,Eb key 38 and an F#/C# key 39. These keys 35 to 39 are arranged within the operating ambit of the right hand little finger. These keys 35 to 39 are operationally connected, via a rotary shaft and arms, to Low Eb to F#/C# pads for closing associated sound holes, respectively.

At position below the group of keys 35 to 39, are arranged on the lower part of the lower joint 20 a Low Eb pad 41, a Low D pad 42, a Low C# pad 43 and a Low C pad 44 on the bell. These pads 41 to 44 are usually urged to open associated sound holes by means of respective needle springs.

When the Low D key 33 is operated in the above-described construction, a rotary shaft 52 is driven for rotation via an arm 51. As a result, an arm 53 rises to kick up an arm 54 at its point and a rotary shaft 55 is driven for rotation. Rotating of the rotary shaft 55 causes turning of the Low Eb key 35 and concurrent rotation of a rotary shaft 56. As a result, the Low D pad 42 is moved to close an associated sound hole against repulsion by a needle spring. Then, the E/B key 36 and the F/C key 37 are also moved to make associated pads close respective sound holes.

During performance of the bass range with this key mechanism, depression of the Low D key 32 causes closure by the Low D pad 42 and depression of the Low C# 32 causes closure of the Low D pad 42 and the Low C# pad 43. Depression of the Low C key 31 causes closure of the Low D pad 42, the Low C# pad 43 and the Low C pad 44. Further, the Low Eb key 35, the E/B key 36, the F#/C# key 39 and the F/C key 37 are operationally coupled to the Low C key 31 for co-movement via an arm 60, a connecting plate 61 and a connecting arm 62. As a consequence, no motion of the right hand little finger is needed for operation of the Low D key 33, the Low C# key 32 and the Low C key 31.

Further, three keys are collectively arranged near the right hand thumb. In addition, thanks to attachment of the rollers to these keys, finger motion between the keys can be performed quite smoothly. The keys to be operated by the right hand little finger are arranged in the conventional manner and, as a consequence, no change in finger motion is required regarding operation of these keys. The keys are operated with the finger motions shown in the following Tables during performance of the bass range.

TABLE 3

| | Note | |
|---|---|---|
| | Low C | Low C# |
| Left hand | | |
| thumb | Thumb key | Thumb key |
| forefinger | F# key | F# key |
| middle finger | A/D key | A/D key |
| ring finger | C/G key | C/G key |
| little finger | | |
| Right hand | | |
| thumb | Low C key | Low C# key |
| forefinger | Bb/F key | Bb/F key |
| middle finger | A/E key | A/E key |
| third finger | D/G key | D/G key |
| little finger | | |

TABLE 4

| | Note | |
|---|---|---|
| | Low D | Low Eb |
| Left hand | | |
| thumb | Thumb key | Thumb key |
| forefinger | F# key | F# key |
| middle finger | A/D key | A/D key |
| ring finger | C/G key | C/G key |
| little finger | | |
| Right hand | | |
| thumb | Low D key | |
| forefinger | Bb/F key | Bb/F key |
| middle finger | A/E key | A/E key |
| third finger | D/G key | D/G key |
| little finger | | Low Eb key |

It is clear from the Tables that, at transit from Low C, Low C# and Low D sounds to Low Eb sound, the right hand little finger is required only to move to the Low Eb key from its free position.

I claim:

1. An improved key mechanism for a bass clarinet comprising a first group of keys collectively arranged within the operating ambit of the right hand thumb on the lower joint of said bass clarinet and including a Low C key, a Low C# key and a Low D key, and a second group of keys arranged separate from said first group of keys within the operating ambit of the right hand little finger on said lower joint and including a Low Eb key, an E/B key and an F/C key, said Low C key closing the Low C sound hole and concurrently depressing said Low C# and Low D keys when operated, said Low C# key closing the Low C# sound hole and concurrently depressing said Low D key when operated, said Low D key closing the Low D sound hole and concurrently depressing said Low Eb key when operated, said Low Eb key closing the Eb sound hole and concurrently depressing said E/B and F/C keys when operated, said E/B key closing the E/B sound hole and concurrently depressing said F/C key when operated and said F/C key closing the F/C sound hole when operated.

* * * * *